US007690979B2

(12) United States Patent
Ogiwara

(10) Patent No.: US 7,690,979 B2
(45) Date of Patent: Apr. 6, 2010

(54) BETTING APPARATUS

(75) Inventor: Takahiro Ogiwara, Tokyo (JP)

(73) Assignee: Universal Entertainment Corporation, Koto-ku, Tokyo (JP)

( * ) Notice: Subject to any disclaimer, the term of this patent is extended or adjusted under 35 U.S.C. 154(b) by 598 days.

(21) Appl. No.: 11/089,013

(22) Filed: Mar. 25, 2005

(65) Prior Publication Data

US 2005/0212210 A1 Sep. 29, 2005

(30) Foreign Application Priority Data

Mar. 26, 2004 (JP) ..... P2004-092105
Mar. 26, 2004 (JP) ..... P2004-092106

(51) Int. Cl.
*A63F 9/00* (2006.01)

(52) U.S. Cl. ..... 463/17; 463/16; 463/30; 273/138.1; 273/139; 273/274

(58) Field of Classification Search ..... 463/1, 463/16–17, 20–21, 23, 25–27, 29–34; 273/138.1, 273/139, 142 B, 142 A, 142 E–142 H, 142 HA, 273/142 J, 142 R, 148 R, 148 B, 304, 309, 273/274; *A63F 09/24*
See application file for complete search history.

(56) References Cited

U.S. PATENT DOCUMENTS 4,321,673 A * 3/1982 Hawwass et al. ..... 463/22
4,396,193 A * 8/1983 Reinhardt et al. ..... 463/22
5,259,616 A * 11/1993 Bergmann ..... 463/17
5,540,442 A * 7/1996 Orselli et al. ..... 463/17
5,588,650 A * 12/1996 Eman et al. ..... 273/142 B
5,770,533 A * 6/1998 Franchi ..... 463/42
5,934,999 A * 8/1999 Valdez ..... 463/17
6,176,489 B1 * 1/2001 Astaneha ..... 273/274
6,209,869 B1 * 4/2001 Mathews ..... 273/138.1
6,217,022 B1 * 4/2001 Astaneha ..... 273/138.1
6,467,770 B1 * 10/2002 Matosevic ..... 273/274
6,659,866 B2 * 12/2003 Frost et al. ..... 463/17
6,743,094 B2 * 6/2004 Johnson ..... 463/17
6,769,693 B2 * 8/2004 Huard et al. ..... 273/274
6,776,714 B2 * 8/2004 Ungaro et al. ..... 463/27

(Continued)

FOREIGN PATENT DOCUMENTS

EA RU 36631 U1 3/2004

(Continued)

OTHER PUBLICATIONS

European Search Report dated Mar. 17, 2008.

(Continued)

*Primary Examiner*—Peter DungBa Vo
*Assistant Examiner*—Arthur O. Hall
(74) *Attorney, Agent, or Firm*—McGinn IP Law Group, PLLC

(57) ABSTRACT

The betting apparatus is configured such that the numbers of a number display portion forming BET areas are displayed in a second BET screen with the same number as those of number plates disposed on a roulette wheel and in a wheel shape in the common array, and such that not only the designated BET area but also the BET areas around the former can be simultaneously bet by setting the bet width in a BET width select unit.

17 Claims, 12 Drawing Sheets

U.S. PATENT DOCUMENTS

| | | | | |
|---|---|---|---|---|
| 6,890,255 | B2 * | 5/2005 | Jarvis et al. | 463/17 |
| 6,921,072 | B2 * | 7/2005 | Hughes-Watts | 273/142 E |
| 7,540,498 | B2 * | 6/2009 | Crenshaw et al. | 273/274 |
| 2002/0037765 | A1 * | 3/2002 | Johnson | 463/17 |
| 2003/0075869 | A1 | 4/2003 | Breeding et al. | |
| 2004/0087357 | A1 * | 5/2004 | Johnson | 463/17 |
| 2004/0147311 | A1 * | 7/2004 | Fujimoto | 463/25 |
| 2004/0164492 | A1 * | 8/2004 | Crenshaw et al. | 273/292 |
| 2005/1003257 | * | 2/2005 | Ohira | 463/17 |

FOREIGN PATENT DOCUMENTS

| | | | |
|---|---|---|---|
| EP | 0 599 769 | | 6/1994 |
| GB | 2 304 295 | A | 3/1997 |
| GB | 2 321 856 | A | 8/1998 |
| GB | 2321856 | A * | 8/1998 |
| GB | 2 321 856 | A | 12/1998 |
| JP | 2003-325726 | | 11/2003 |
| WO | WO 98/17360 | | 4/1998 |
| WO | WO 99/11341 | | 3/1999 |
| WO | WO 01/47445 | A1 | 7/2001 |

OTHER PUBLICATIONS

Peruvian Office Action dated Aug. 13, 2007.

* cited by examiner

BETTING APPARATUS

CROSS-REFERENCE TO THE RELATED APPLICATION(S)

This application is based upon and claims a priority from prior Japanese Patent Applications No. 2004-092105 and No. 2004-092106 filed on Mar. 26, 2004, the entire contents of which are incorporated herein by reference.

BACKGROUND OF THE INVENTION

1. Field of the Invention

The present invention relates to a betting apparatus for use in a gaming machine such as a roulette game machine and, more particularly, to a betting apparatus, in which the amusements of the gaming machine are diversified by forming the betting areas to be displayed on the betting apparatus, on the basis of the same symbols arranged in a common array as those of a roulette wheel and by making it possible to bet chips simultaneously for a plurality of bet areas including a selected bet area.

2. Description of the Related Art

In the so-called "medal game"using medals as the game media of a slot machine, a roulette game machine or a card game machine, the player can start the game by purchasing or borrowing a plurality of medals from a medal lending machine and by inserting the medal or medals into the game machine. If the player wins the game, the player is awarded by a predetermined number of medals. Therefore, the player having acquired many medals can enjoy the game continuously without purchasing or borrowing new medals. Especially the roulette game machine is played by betting the medals purchased or borrowed from the medal lending machine, for the number expected to win.

In the betting method of the prior art for the player to bet in the roulette game machine, moreover, the betting board displayed on a monitor display is used, as disclosed in JP-A-2003-325726. In this betting board, a plurality of numerals (including letters) are arrayed in a checker shape as the figure letters including the same numerals as those displayed on the wheel. By using the betting board arrayed in the checker shape, moreover, the numeral to win is expected and bet for the chips.

In the roulette game machine disclosed in JP-A-2003-325726, however, no relation exists in the array between the symbols arranged on the roulette wheel and the symbols displayed on the betting board. The player expects the symbol and bets the chips with reference to the betting board. Even if, therefore, the player expects the symbol to be bet by observing the roulette wheel visually, the player has to look for the corresponding symbol on the betting board before the betting, and this is troublesome works for the player.

Even in case the chips are to be bet for all the symbols arranged within a predetermined range on the roulette wheel, the array of the symbols on the betting board are absolutely different from that of the symbols on the roulette wheel. This absolute difference makes it difficult to bet all the desired symbols within a limited time period.

SUMMARY OF THE INVENTION

The invention has been conceived to solve the problems of the prior art thus far described, and has an object to provide a betting apparatus which allows the player to bet chips easily for a player and simultaneously for a plurality of bet areas including a selected one, by arranging symbols on a betting board visually in the same array as that of the symbols arranged on a roulette wheel, so that the amusements of the game machine can be diversified to stimulate the playing interests of the player. According to the betting apparatus, moreover, even the beginner of the roulette game machine can understand and bet the game easily.

To the symbol, there is usually assigned any of natural numbers 0 to 36 (which may include 00). Besides, the symbol is assigned symbols and images.

In order to achieve the above-specified object, according to a first aspect of the invention, there is provided a betting apparatus including: a bet area display unit for displaying a plurality of bet areas formed on the basis of the same symbols of a plurality of symbols arranged on a roulette wheel; a select unit for selecting the individual bet areas displayed by the bet area display unit; and a bet unit for betting the bet area selected by the select unit, wherein the bet areas are formed on the basis of symbols arranged in a wheel shape in the same array as the symbols arranged on the roulette wheel.

In the betting apparatus according to the first aspect of the invention, the bet areas are formed on the basis of the symbols which are arranged in the wheel shape in the same array as that of the symbols arrayed on the roulette wheel. This makes it possible to expect the bet area to be bet, in visual correlation to the array of the symbols actually displayed on the roulette wheel. On the basis of the arrangement of the symbols of the roulette wheel, therefore, the bet area to be bet can be expected to diversify the amusements so that the player will not lose interest. Moreover, even the beginner can understand the roulette game machine easily so that the player can easily bet.

BRIEF DESCRIPTION OF THE DRAWINGS

These and other objects and advantages of the present invention will be more fully apparent from the following detailed description taken in conjunction with the accompanying drawings, in which.

DETAILED DESCRIPTION OF THE PREFERRED EMBODIMENTS

A betting apparatus according to the invention will be described in detail in connection with its embodiments, in which it is embodied in satellites disposed in a roulette game machine, with reference to the accompanying drawings. Here, the satellite or satellites are termed as one or more play zones, which are disposed for various medal game machines such as the roulette machine or a card game machine so that the player may bet game media such as medals while expecting the result of the game.

This embodiment will be described on satellites 2 (as referred to FIG. 1), which are disposed in a roulette game machine 1. In connection with the roulette game machine 1, the player expects a number or the like to be decided in the roulette, and bets the game media such as medals on the expected number or the like. If the bet number or the like hits, the player can receive a payout of a predetermined number of medals.

Figure 1:
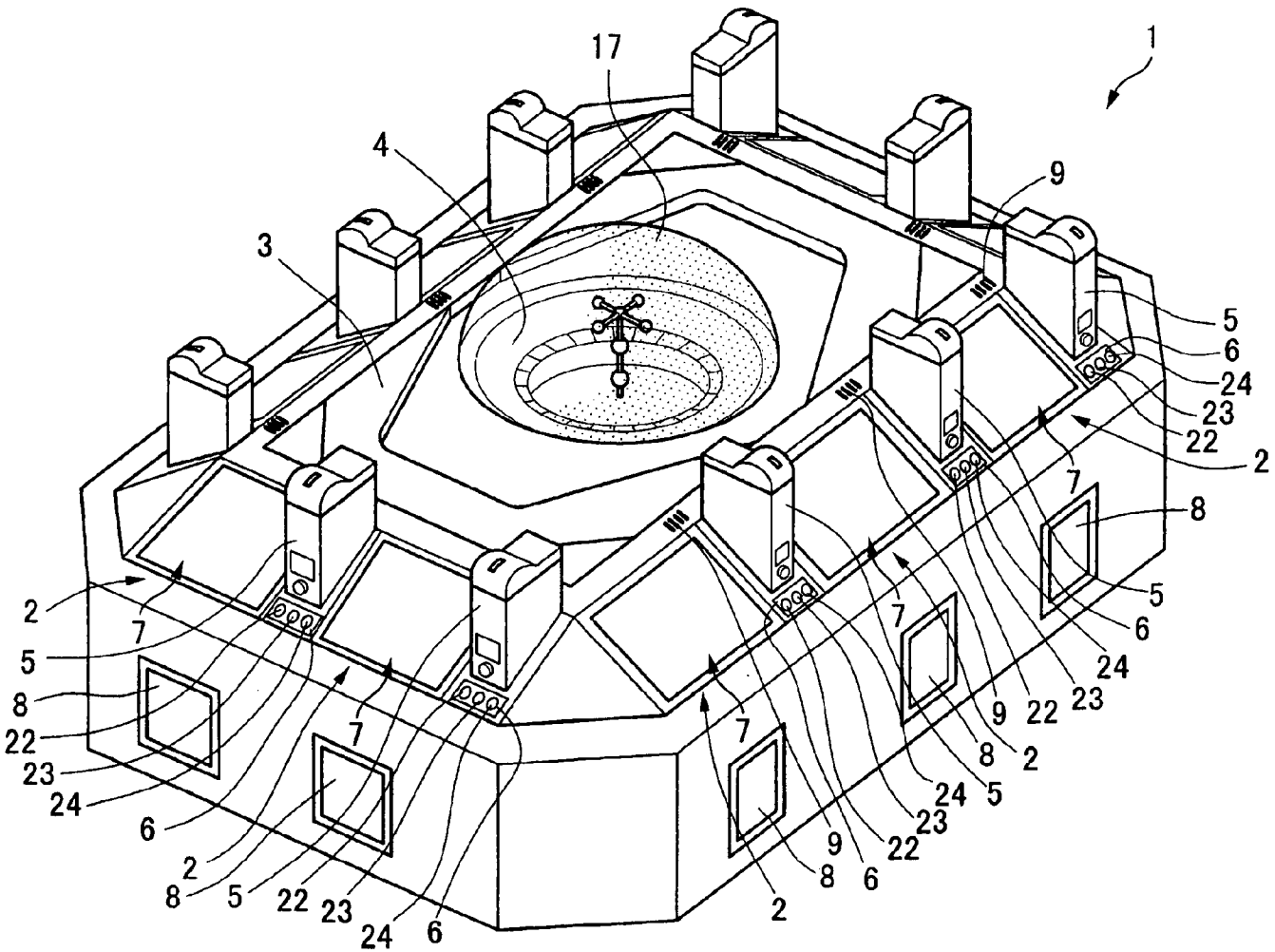
FIG. 1 is an exterior, perspective view showing the schematic configuration of a roulette game machine according to the embodiment.

First of all, the schematic configuration of the roulette game machine 1 according to this embodiment is described with reference to FIG. 1. FIG. 1 is an exterior, perspective view showing the schematic configuration of the roulette game machine according to this embodiment.

As shown in FIG. 1, the roulette game machine 1 is basically configured to include: a casing 3 forming a body portion; a roulette wheel 4 disposed at a generally central portion of the upper face of the casing 3; and the plural (e.g., ten in the embodiment) satellites 2 disposed around the roulette wheel 4.

Here, the satellite is a play zone including: a medal accepting device 5 for accepting game media such as coins or medals inserted thereinto for the game; a control unit 6 composed of a plurality of control buttons or the like, to which the player inputs predetermined instructions; and an image display device 7 for displaying images relating to the game. Thus, the player can operate the control unit 6 or the like while observing the images displayed on the image display device 7, thereby to advance the game being developed.

A medal payout opening 8 is disposed in that side face of the casing, on which each satellite 2 is disposed. At the right-hand upper portion of the image display device 7 of the satellite 2, moreover, there is disposed a speaker 9 for making music, an effect sound and so on.

Figure 2:
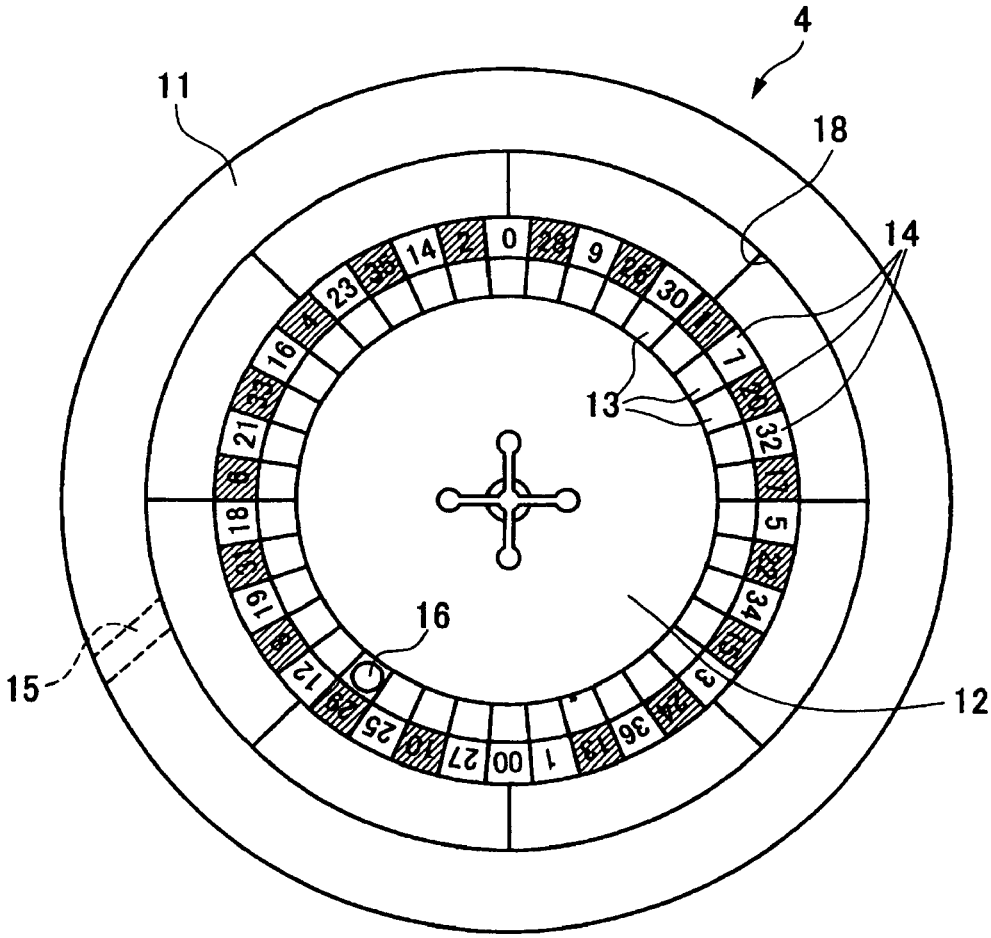
FIG. 2 is a top plan view of the roulette wheel according to the embodiment.

The configuration of the roulette wheel 4 of this embodiment will be described with reference to FIG. 2. FIG. 2 is a top plan view of the roulette wheel of the embodiment.

As shown in FIG. 2, the roulette wheel 4 is basically configured of a frame bowl 11 fixed in the casing 3, and a rotating wheel 12 housed and supported rotatably on the inner side of the frame bowl 11. A number of (e.g., thirty eight in this embodiment) recessed ball receiving compartments 13 are formed in the upper face of the rotating wheel 12. On the upper face of the rotating wheel 12 outside of the individual ball receiving compartments 13, moreover, there are formed number plates 14, on which numerals "0", "00", - - - , and "36" as figure letters are displayed to correspond to the individual ball receiving compartments 13.

A ball charging hole 15 is formed in the frame bowl 11. The not-shown ball charge device is connected to the ball charging hole 15 so that a ball 16 is charged from the ball charging hole 15 onto the rotating wheel 12, as the ball charge device is driven. On the other hand, the roulette wheel 4 is covered all over with a cover member 17, which is formed of a transparent acrylic resin into a hemispheric shape.

Here, the frame bowl 11 is gently sloped inward and is provided with a guide wall 18 at its intermediate portion. This guide wall 18 guides the charged ball 16 against the centrifugal force so that the ball 16 may roll. As the ball 16 lowers its rolling speed to lose the centrifugal force, it rolls down the slope of the frame bowl 11 inward to the rotating wheel 12.

The ball 16 thus rolling down to the rotating wheel 12 runs on the number plates 14 outside of the rotating wheel 12 so that it is received by any of the ball receiving compartments 13. The winning number is located at the number of the number plate 14 corresponding to the ball receiving compartment 13, which received the ball 16.

Below the roulette wheel 4, moreover, there is disposed the (not-shown) win decide device. This win decide device is a device for deciding what number ball receiving compartment the ball 16 has been received by. The not-shown ball recovering device is also disposed below the rotating wheel 12. This ball recovering device is a device for recovering the ball 16 on the rotating wheel 12. The ball charge device, the win decide device and the ball recovering device are well known in the art so that their detailed description is omitted.

Here will be described the configurations of the control unit 6 and the image display device 7 of this embodiment.

The control unit 6 is disposed at the satellite 2 on the side portion of the image display device 7, as shown in FIG. 2, and is provided with individual buttons to be operated by the player. A BET decide button 22, a PAYOUT button 23 and a HELP button 24 are arranged sequentially in the recited order from the lefthand side, as viewed from a position confronting the satellite 2.

The BET decide button 22 is pushed when a bet is decided after the betting operation by the later-described image display device 7. The game wins in case the bet is decided and made on the number which is written on the number plate 14 corresponding to such a ball receiving compartment 13 in the roulette wheel 4 as received the ball 16. In this winning case, the credit corresponding to the bet chip number is added to the credit being owned by the player. This betting operation will be described in detail.

The PAYOUT button 23 is usually pushed at the end of a game. When the PAYOUT button 23 is pushed, the medals of a number corresponding to the credit, which has been acquired in the game or the like and is being owned by the player (e.g., usually one medal for one credit), is paid back from the medal payout opening 8.

The HELP button 24 is pushed in case the method or the like for playing the game is unknown. Immediately after the HELP button 24 was pushed, a help screen displaying various pieces of operation information is displayed on the image display device 7.

Figure 3:
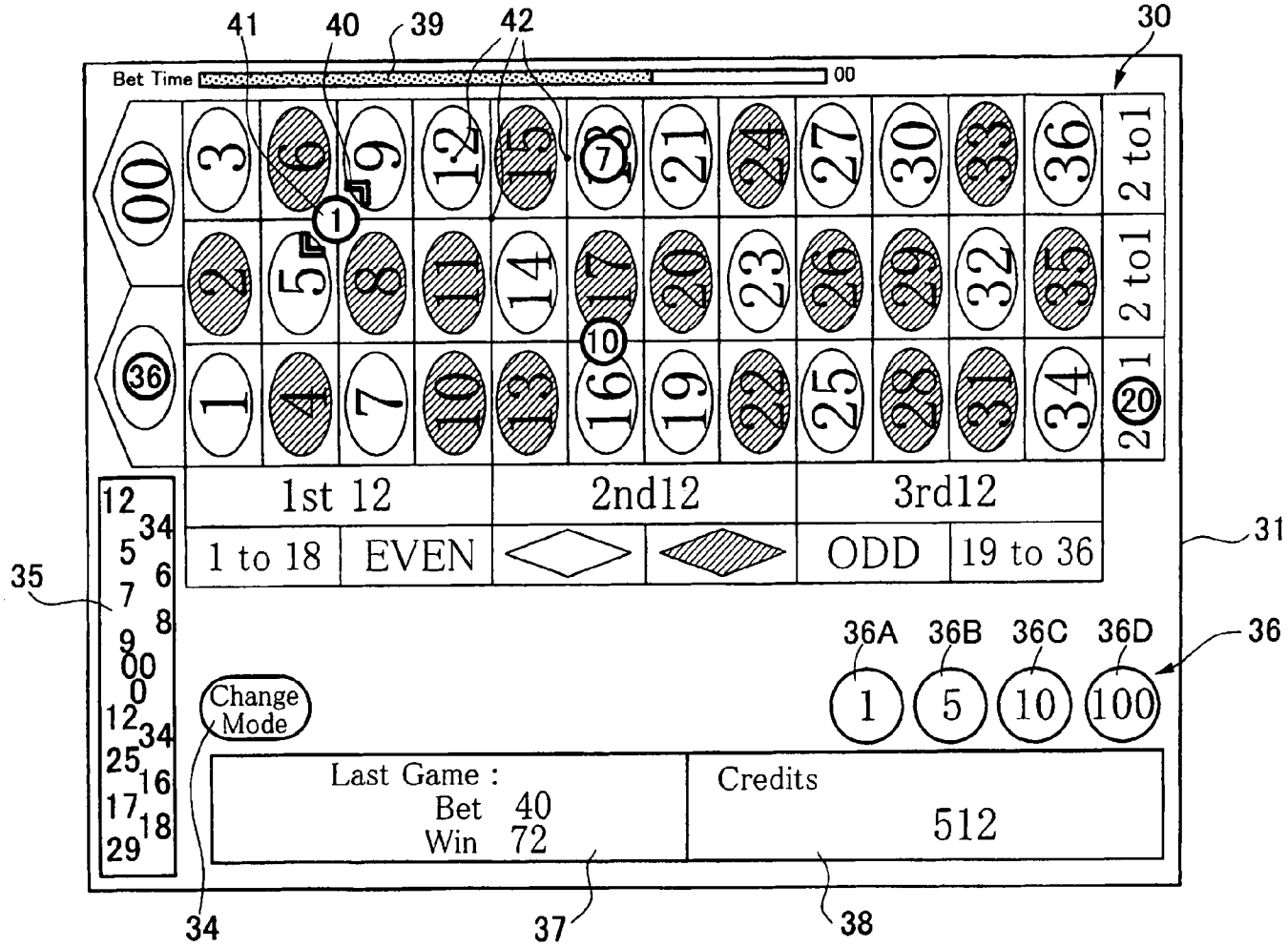
FIG. 3 is a diagram showing one example of the display screen displayed on the image display device.
Figure 4:
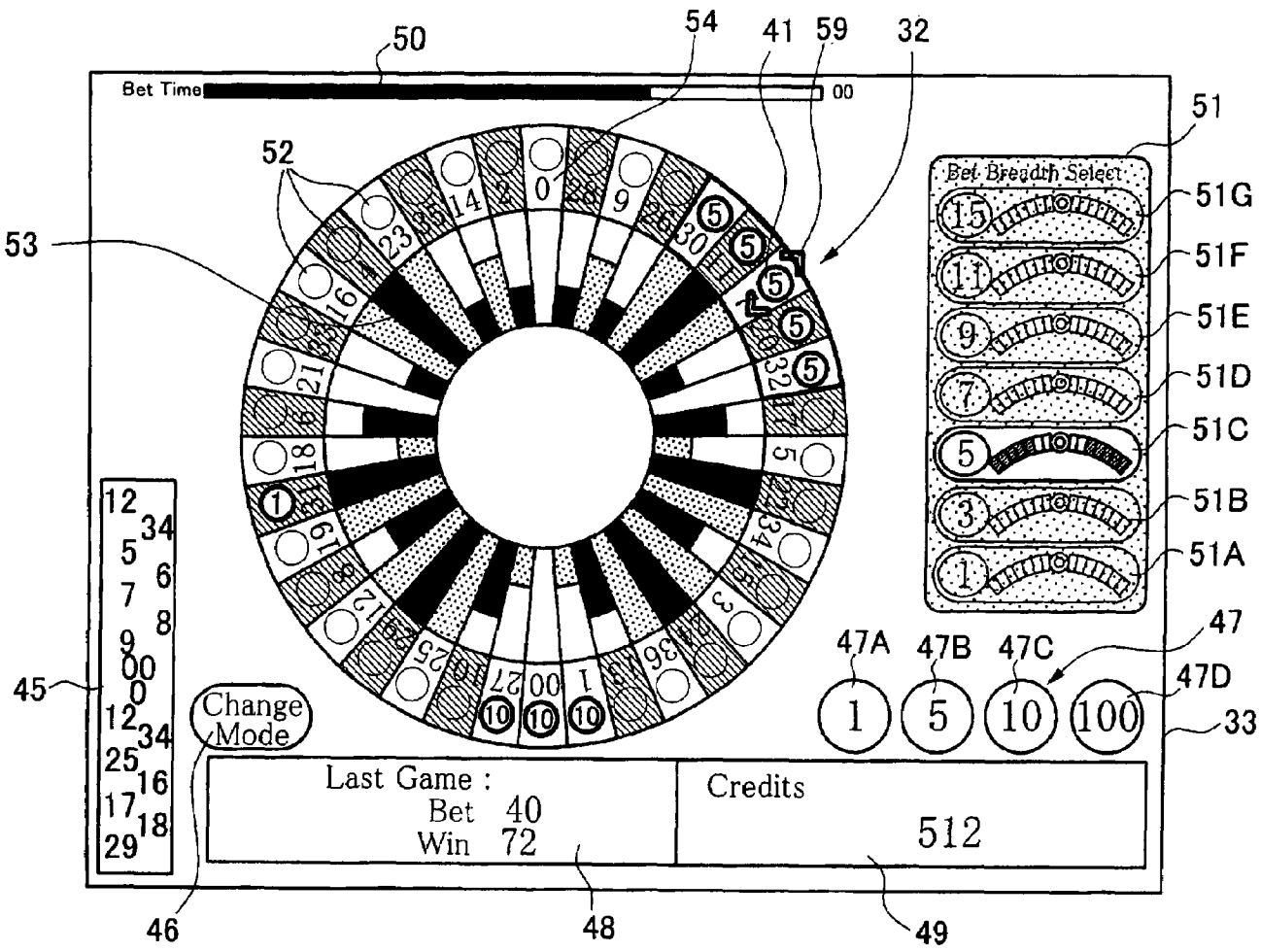
FIG. 4 is a diagram showing one example of the display screen displayed on the image display device.

On the other hand, the image display device 7 is the so-called "touch panel type" liquid crystal display having a touch panel 28 attached to its front face. An icon displayed on the liquid crystal screen can be selected by selecting it with a finger or the like. FIG. 3 and FIG. 4 are diagrams showing examples of the display screens which are displayed during the play on the image display device.

On the image display device 7 during the play of the roulette game machine 1, as shown in FIG. 3 and FIG. 4, there are displayed totally two kinds of screens: a first BET screen 31 having a table type betting board 30; and a second BET screen 33 having a wheel type betting board 32. These first and second BET screens 31 and 33 can be interchanged in their displays, each time screen change buttons 34 and 46 displayed on the screen. Thus, the player can bet chips by using his or her own credit after the player selected one of the first BET screen 31 and the second BET screen 33.

At first, the first BET screen 31 is described with reference to FIG. 3. On the table type betting board 30 displayed on the first BET screen 31, there are arrayed and displayed in a checker pattern the same numerals as those "0", "00", "1", - - - , and "36" displayed on the number plates 14. Also arranged in a checker pattern are special BET areas for betting the chips by designating "ODD number", "EVEN number", "Color Kind (RED or BLUE) of the number plates", and "Predetermined Number Range (e.g., "1" to "12")".

A result history display unit 35, the screen change button 34, a unit BET button 36, a payout result display unit 37 and a credit number display unit 38 are also arranged sequentially in the recited order from the lefthand side in the lower portion of the table type betting board 30.

The result history display unit 35 displays a list of the results of the winning numbers in the games to the latest one (wherein one game is a series of operations for the player to make a BET at each satellite 2, for the ball 16 to fall down onto the ball receiving compartment 13, and for the credit to be paid back on the basis of the winning number). When one game is ended, a new winning number is additionally displayed in that list so that the player can confirm the history of the winning numbers of sixteen games at most.

On the other hand, the screen change button 34 changes the first BET screen 31 and the second BET screen 33 to be displayed on the image display device 7, as described above. When the player pushes the screen change button 34 on the liquid crystal screen, the first BET screen 31 using the table type betting board 30 can be displayed in place of the second BET screen 33 using the wheel type betting board 32. After this, the player can bet the chips on the basis of the betting board on the screen being displayed.

On the other hand, the unit BET button 36 is a button for betting a BET area 42 (i.e., a checker of the number and symbol, or one of the lines forming the checkers) designated by the player. The unit BET button 36 is composed of four kinds: a 1-BET button 36A, a 5-BET button 36B, a 10-BET button 36C and a 100-BET button 36D.

At first, the player pushes the screen at the BET area 42 to be bet, directly with the finger or the like thereby to designate a later-described cursor 40. When the player pushes the 1-BET button 36A in this state, the player bets the chips one by one (that is, the bet number increases in the sequence of "1"→"2"→"3" - - - , each time the player pushes the 1- button 36A with the finger or the like). When the player pushes the 5-BET button 36B, on the other hand, the player bets the chips at the unit of five (that is, the bet number increases in the sequence of "5"→"10"→"15"→ - - -, each time the player pushes the 5-BET button 36B with the finger or the like). When the player pushes the 10-BET button 36C, on the other hand, the player bets the chips at the unit of ten (that is, the bet number increases in the sequence of "10"→"20"→"30"→ - - - , each time the player pushes the 10-BET button 36C with the finger or the like). When the player pushes the 100-BET button 36D, moreover, the player bets the chips at the unit of hundred (that is, the bet number increases in the sequence of "100"→"200"→"300"→ - - - , each time the player pushes the 100-BET button 36D with the finger or the like).

As a result, even when many chips are to be bet, the betting operation can be simplified.

The payout result display unit 37 displays the bet number of the chips and the payout number of the credits of the player in the latest game. Here, the difference of the payout credit number from the bet number is the credit number, which is newly acquired by the player as a result of the latest game.

Moreover, the credit number display unit 38 displays the number of the credits owned at present by the player. This credit number decreases, when the chips are bet, by the bet number (i.e., at the rate of one credit for one chip). In case the bet number hits so that the credits are paid back, on the contrary, the credit number increases by the payout number. In case the credit number owned by the player decreases to 0, the game is over.

A BET timer graph 39 is disposed above the table type betting board 30. The BET timer graph 39 indicates the residual time, for which the player can bet, and begins to gradually extend rightward from the game starting time. When the graph extends to the righthand end, the betting time period in the game being played is finished. In case the BET timer graph 39 reaches a predetermined position (e.g., a 2/3 position), the ball 16 is charged into the roulette wheel 4 by the ball charge device of the roulette wheel 4.

On the table type betting board 30, moreover, there are displayed: the cursor 40 for indicating the BET area 43 being selected by the player; and a chip symbol 41 indicating the chip number having been bet till then and the BET area 42. The numeral displayed on the chip symbol 41 indicates the number of bet chips. As shown in FIG. 3, for example, the chip symbol 41 of "7" placed at the checker "18" indicates that seven chips are bet at the number "18". This method for betting only one number is called the "straight-up" betting method.

On the other hand, the chip symbol 41 of "1" placed at the intersection of the checkers "5", "6", "8" and "9" indicates that the four numbers "5", "6", "8" and "9" are covered to bet one chip. This betting method for covering the four numbers is called the "corner bet" betting method.

Other betting methods are: the "split bet" betting method, by which two numbers are covered to bet by placing the chip symbol on the line between the two numbers; the "street bet" betting method, by which three numbers (e.g., "13", "14" and "15") are covered to bet by placing the chip symbol on one transverse line of the numbers (i.e., one vertical ling in FIG. 3); the "five bet" betting method, by which five numbers of "0", "00", "1", "2" and "3" are covered to bet by placing the chip symbol on the line between the numbers "00" and "3" ; the "line bet" betting method, by which six numbers (e.g., "13", "14", "15", "16", "17" and "18") are covered to bet by placing the chip symbol between the numbers of two transverse lines (i.e., two vertical lines in FIG. 3); the "column bet" betting method, by which twenty numbers are covered to bet by placing the chip symbol on the checker written as "2 to 1"; and the "dozen bet" betting method, by which twelve numbers are covered to bet by placing the chip symbol on each of the checkers "1st12", "2nd12" and "3rd12". The remaining methods cover eighteen numerals to bet by using such six checkers disposed at the lowermost stage of the table type betting board 30 as correspond to the color (i.e., "red" or "black") of the number display plate, the odd/even of the number, and whether the number is 18 or less or 19 or more.

When the player is to bet on the first BET screen 31 thus configured, the player designates the BET area 42 (e.g., the checker of a number or symbol, or the line forming a checker) to be bet, and pushes the BET area 42 directly with his or her finger. As a result, the cursor 40 moves to the BET area 42 designated.

After this, the player pushes the individual unit buttons (i.e., the 1-BET button 36A, the 5-BET button 36B, the 10-BET button 36C and the 100-BET button 36D) of the unit BET button 36. Then, the chips of their unit numbers are bet on the BET area 42 designated. When the 10-BET button 36C, the 5-BET button 36B and the 1-BET button 36A are pushed four times, one time and three times, respectively, totally forty eight chips can be bet.

Next, the second BET screen 33 is described with reference to FIG. 4. On the wheel type betting board 32 displayed on the second BET screen 33, the same numerals as those "0", "00", "1", - - - , and "36" displayed on the number plates 14 are displayed in the same wheel array as that of the actual roulette wheel 4.

A result history display unit 45, the screen change button 46, a unit BET button 47, a payout result display unit 48 and a credit number display unit 49 are arranged as in the aforementioned first BET screen 31 in the lower portion of the wheel type betting board 30.

The result history display unit 45 displays a list of the results of the winning numbers in the games to the latest one (wherein one game is a series of operations for the player to make a BET at each satellite 2, for the ball 16 to fall down onto the ball receiving compartment 13, and for the credit to be paid back on the basis of the winning number) . When one game is ended, a new winning number is additionally displayed in that list so that the player can confirm the history of the winning numbers of sixteen games at most.

On the other hand, the screen change button 46 changes the first BET screen 31 and the second BET screen 33 to be displayed on the image display device 7, as described above. When the player pushes the screen change button 46 on the liquid crystal screen, the first BET screen 31 using the table type betting board 30 can be displayed in place of the second BET screen 33 using the wheel type betting board 32. After this, the player can bet the chips on the basis of the betting board on the screen being displayed.

On the other hand, the unit BET button 47 is a button for betting a BET area 62 (i.e., a number display portion 54 displaying numbers) designated by the player. The unit BET button 47 is composed of four kinds: a 1-BET button 47A, a 5-BET button 47B, a 10-BET button 47C and a 100-BET button 47D.

At first, the player pushes the BET area 52 to be bet, directly with the finger or the like. Moreover, a later-described cursor 59 is arranged in the BET area 52 designated. In the wheel type betting board 32 of the second BET screen 33, one BET area 52 for betting the chip is disposed for one numeral displayed. When the player pushes the 1-BET button 47A in this state, the player bets the chips one by one (that is, the bet number increases in the sequence of "1"→"2"→"3"→ - - - , each time the player pushes the 1-BET button 47A with the finger or the like) . When the player pushes the 5-BET button 47B, on the other hand, the player bets the chips at the unit of five (that is, the bet number increases in the sequence of "5"→"10"→"15"→ - - - , each time the player pushes the 5-BET button 47B with the finger or the like). When the player pushes the 10-BET button 47C, on the other hand, the player bets the chips at the unit of ten (that is, the bet number increases in the sequence of "10"→"20"→"30"→ - - - , each time the player pushes the 10-BET button 47C with the finger or the like). When the player pushes the 100-BET button 47D, moreover, the player bets the chips at the unit of hundred (that is, the bet number increases in the sequence of "100"→"200"→"300"→ - - - , each time the player pushes the 100-BET button 47D with the finger or the like) As a result, even when many chips are to be bet, the betting operation can be simplified.

On the other hand, the payout result display unit 48 displays the bet number of the chips and the payout number of the credits of the player in the latest game. Here, the difference of the payout credit number from the bet number is the credit number, which is newly acquired by the player as a result of the latest game.

Moreover, the credit number display unit 49 displays the number of the credits owned at present by the player. This credit number decreases, when the chips are bet, by the bet number (i.e., at the rate of one credit for one chip). In case the bet number of the BET area 52 hits so that the credits are paid back, on the contrary, the credit number increases by the payout number. In case the credit number owned by the player decreases to 0, the game is over.

Moreover, the second BET screen 33 is provided above the wheel type betting board 32 with a BET timer graph 50, as in the aforementioned first BET screen 31. The BET timer graph 50 indicates the residual time, for which the player can bet, and begins to gradually extend rightward from the game starting time. When the graph extends to the righthand end, the betting time period in the game being played is finished. In case the BET timer graph 50 reaches a predetermined position (e.g., a 2/3 position), the ball 16 is charged into the roulette wheel 4 by the ball charge device of the roulette wheel 4.

Figure 5:
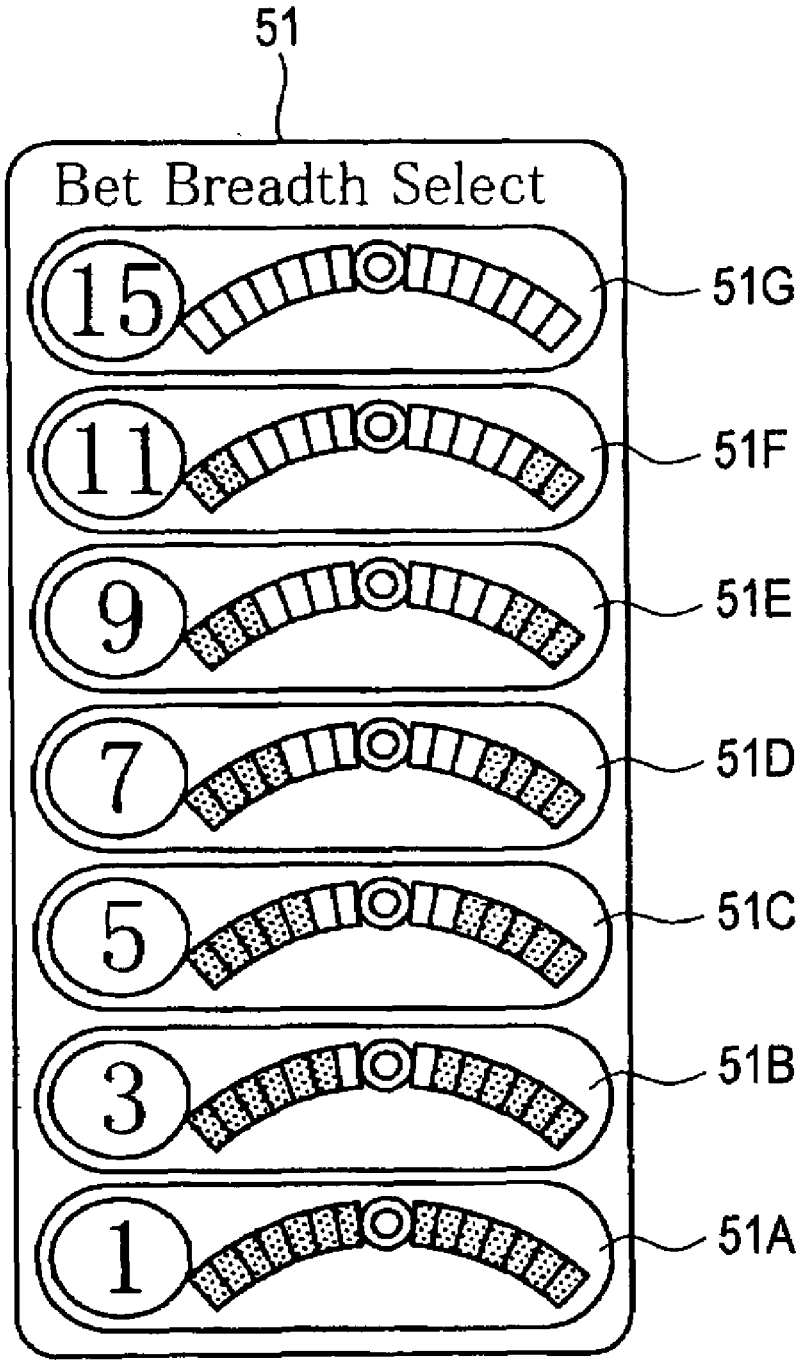
FIG. 5 is a schematic diagram showing a BET width select unit according to the embodiment in an enlarged scale.

On the righthand side of the wheel type betting board 32 of the second BET screen 33, there is disposed a BET width select unit 51. This BET width select unit 51 provides the wheel type betting board 32 with a special function to bet not only the BET area 52 designated but also the BET areas 52 around the designated one by selecting the bet width in the BET width select unit 51. The BET width select unit 51 is composed of seven kinds of buttons of a 1-width select button 51A, a 3-width select button 51B, a 5-width select button 51C, a 7-width select button 51D, a 9-width select button 51E, a 11-width select button 51F and a 15-width select button 51G. These select buttons can select the bet widths at "1", "3", "5", "7", "9", "11" and "15", respectively. Here, the bet width indicates the total BET area numbers including the BET area 52 selected and the BET areas 52 which are arranged on the two sides of the selected one and which can be simultaneously bet. FIG. 5 is a schematic diagram showing the BET width select unit 51 according to this embodiment in an enlarged scale.

As shown in FIG. 5, the 1-width select button 51A selects and bets only the designated BET area 52. On the other hand, the 3-width select button 51B selects and simultaneously bets a total of three BET areas 52: the designated BET area 52; and the two BET areas 52 of the adjoining numbers. The 5-width select button 51C selects and simultaneously bets a total of five BET areas 52: the designated BET area 52; and the four BET areas 52 of the two adjoining number sets. The 7-width select button 51D selects and simultaneously bets a total of seven BET areas 52: the designated BET area 52; and the six BET areas 52 of the three adjoining number sets. The 9-width select button 51E selects and simultaneously bets a total of nine BET areas 52: the designated BET area 52; and the eight BET areas 52 of the four adjoining number sets. The 11-width select button 51F selects and simultaneously bets a total of eleven BET areas 52: the designated BET area 52; and the ten BET areas 52 of the five adjoining number sets. The 15-width select button 51G selects and simultaneously bets a total of fifteen BET areas 52: the designated BET area 52; and the fourteen BET areas 52 of the seven adjoining number sets.

The player can select each bet width by pushing the button of his or her desired bet width so that the player can bet the chips on the basis of the selected bet width (i.e., any of "1", "3", "5", "7", "9", "11" and "15").

The betting method for the wheel type betting board 32 is usually limited to one (i.e., the "straight-up" in the table type betting board 30) for betting one BET area 52 designated. By selecting the bet width in the BET width select unit 51, however, it is possible to bet a total of the chips of the designated BET area 52 (or number) and BET areas 52 (or numbers) of the sets of equal numbers symmetric with respect to that BET area 52. In case the bet width "5" is selected by the 5-width select button 51C and in case the checker of the number "7" is designated as the BET area 52, for example, it is possible to simultaneously bet the five BET areas 52 (i.e., the numbers "30", "11", "7", "20" and "32") arranged around the number "7".

Figure 6:
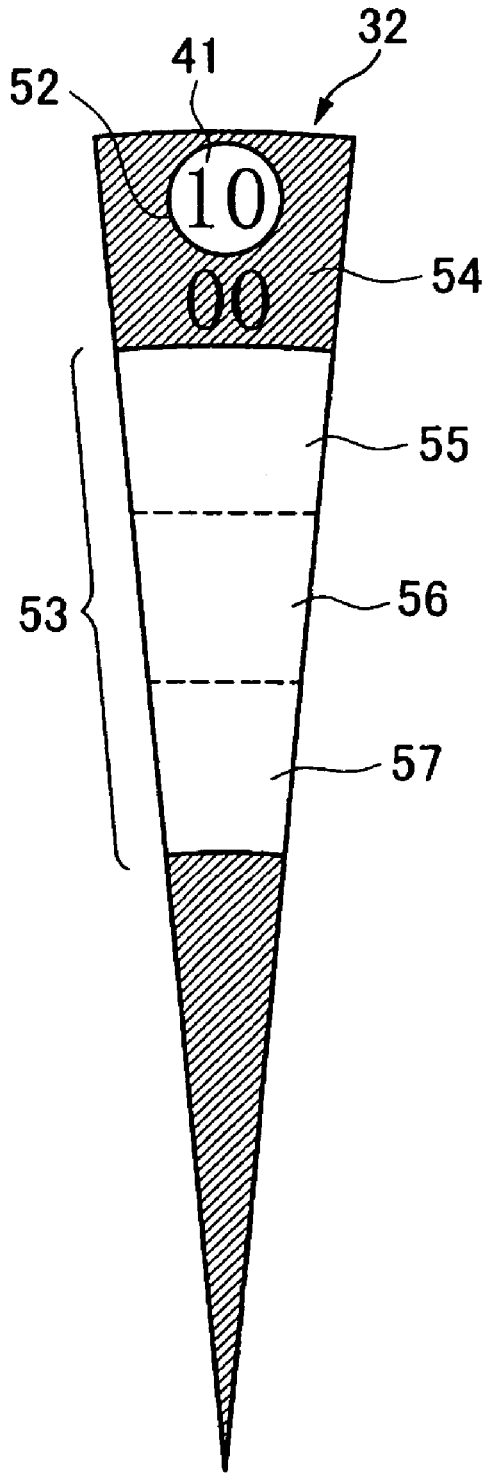
FIG. 6 is a schematic diagram showing a portion of a wheel type betting board in an enlarged scale.

In the wheel type betting board 32 of the second BET screen 33, a history graph 53 is so disposed in a wheel shape within the circle of the number display portion 54 having the individual numbers as to correspond to the individual bet areas 52. The history graph 53 plots the history of the BET areas 52 (or numbers) having hit till the latest game, so that the history may be visually easily understood. FIG. 6 is a schematic diagram showing a portion of the wheel type betting board in an enlarged scale.

As shown in FIG. 6, the history graph 53 is composed of three areas: a first graph area 55, a second graph area 56 and a third graph area 57, which are arranged on the inner side of the number display portion 54 indicating the numbers and which correspond to the individual numbers. Each of these areas is lit and indicated (as referred to FIG. 4) on the basis of the history of the winning numbers (or the winning percentages).

Specifically, in case at least one win has occurred in the past 100 games, the first graph area corresponding to the winning number (i.e., the winning BET area 52) is lit. In case three or more wins have occurred, the second graph area corresponding to the winning number is lit. In case five or more wins have occurred, the third graph area corresponding to the winning number is lit. When the player wants to know the past game results, the player can decide it visually easily what position of the roulette wheel 4 and how often the ball 16 has fallen to. This effect is better improved, because the numerals in the wheel type betting board 32 displayed in the second BET screen 33 are displayed in the same wheel-shaped array as that of the actual roulette wheel 4, as described above.

Alternatively of the lit displays of the individual graph areas 55 to 57, moreover, these graph areas 55 to 57 may also be discriminated by changing the colors of their colors from the surroundings.

In the wheel type betting board 32, moreover, not only the designated BET area 52 but also the adjoining BET areas 52 can be simultaneously bet by selecting the bet width in the BET width select unit 51. As a result, the player can bet the numbers adjoining the point of the ball 16 easily while expecting the point from the history graph 53. Thus, the player can enjoy a wide variety of play styles with stimulated playing interests.

By pushing the screen change button 46, on the other hand, the player can display and bet the first BET screen 31 using the table type betting board 30. Thus, the bet can be made to satisfy the various desires of the player.

On the wheel type betting board 32, on the other hand, there are displayed the cursor 59 indicating the BET area 52 being selected by the player, and the chip symbol 41 indicating the number of chips bet till then and the BET area 52. The numeral displayed on the chip symbol 41 indicates the bet number of the chips. For example, the chip symbol 41 of "1" placed at the checker "31", as shown in FIG. 4, indicates that one chip is bet for the number "31".

When the player is to bet on the second BET screen 33 thus configured, the player designates the BET area 52 (i.e., the number displayed in the number display portion 54) to be bet and pushes that area directly with his or her finger. As a result, the cursor 59 moves to the designated BET area 52.

After this, the player designates the his or her desired bet width by pushing one of the select buttons in the BET width select unit 51, that is, one of the 1-width select button 51A, the 3-width select button SIB, the 5-width select button 51C, the 7-width select button 51D, the 9-width select button 51E, the 11-width select button 51F and the 15-width select button 51G. Then, the player pushes the individual unit buttons (i.e., the 1-BET button 36A, the 5-BET button 36B, the 10-BET button 36C and the 100-BET button 36D) so that the chips corresponding to the selected units are bet for the designated BET area 52 (i.e., simultaneously for the plural BET areas 52, in case the bet width other than "1" is designated). When the numerals "10", "5" and "1" of the unit BET button 47 is pushed four times, one time and three times, respectively, a total of forty eight chips can be bet.

Further, in the second BET screen 33, a (not-shown) second history graph is disposed outside of the wheel type betting board 32. The second history graph is composed of four areas. The number of bet areas having similar winning ratio is displayed in each four areas. For example, in case the symbols "0", "11" and "27" are respectively won equal to or more than five times in the past 100 games, the number of the symbols which was won equal to or more than five times in the past 100 game "3" is displayed in one in the four areas.

The player can easily know how many numbers have similar winning percentage. Further, the player can select each area by pushing the desired area, and can simultaneously bet a plurality of the numbers that have similar winning percentage.

Figure 7:
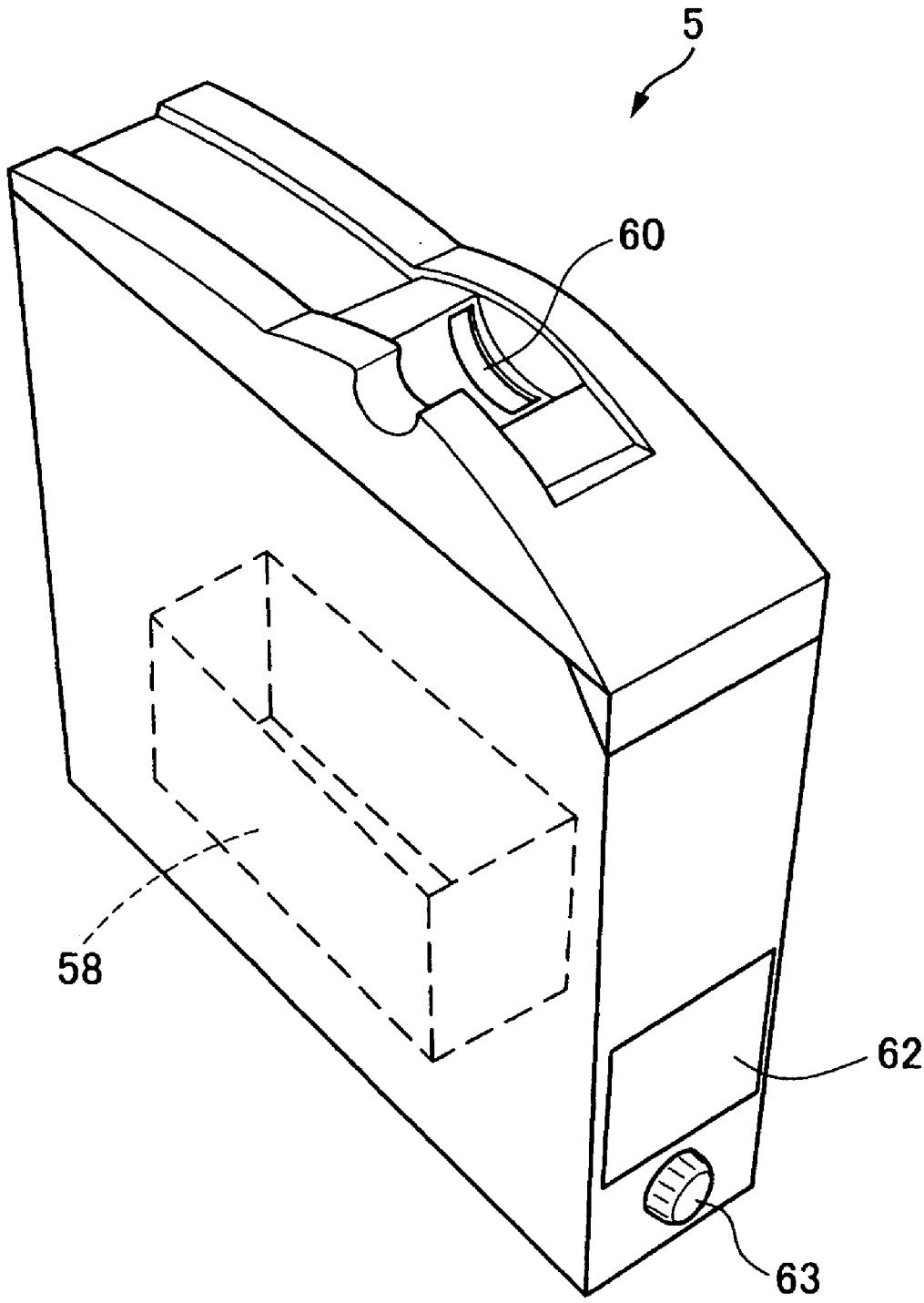
FIG. 7 is a perspective view showing a medal accepting device according to the embodiment.

Next, the configuration of the medal accepting device 5 according to this embodiment is described with reference to FIG. 7. FIG. 7 is a perspective view showing the medal accepting device 5 according to this embodiment.

As shown in FIG. 7, the medal accepting device 5 has a general box shape for accepting game media such as coins or medals inserted thereinto for the game. The credit number according to the game media accepted is added to that owned by the player so that the credit number display unit 38 or 49 is updated to display the summed credit number.

Moreover, the medal accepting device 5 is provided with: a medal insert opening 60, into which coins or medals are inserted; a medal return opening 62 for returning the inserted medals or the like to the player; and a key insert hole 63 which is used for opening/closing the inside of the medal accepting device 5.

Here, the key insert hole 63 is a hole for the (not-shown) key to opening/closing the (not-shown) door attached to the medal accepting device 5. When the predetermined key is inserted and turned in the predetermined direction, the key device is released from its locked state so that the door is opened. In the medal accepting device 5, there is disposed a medal accommodating tray 58 for accommodating the medals inserted. When the door is opened, the medals in the medal accepting device 5 can be recovered, and the inside of the medal accepting device 5 can be maintained.

Figure 8:
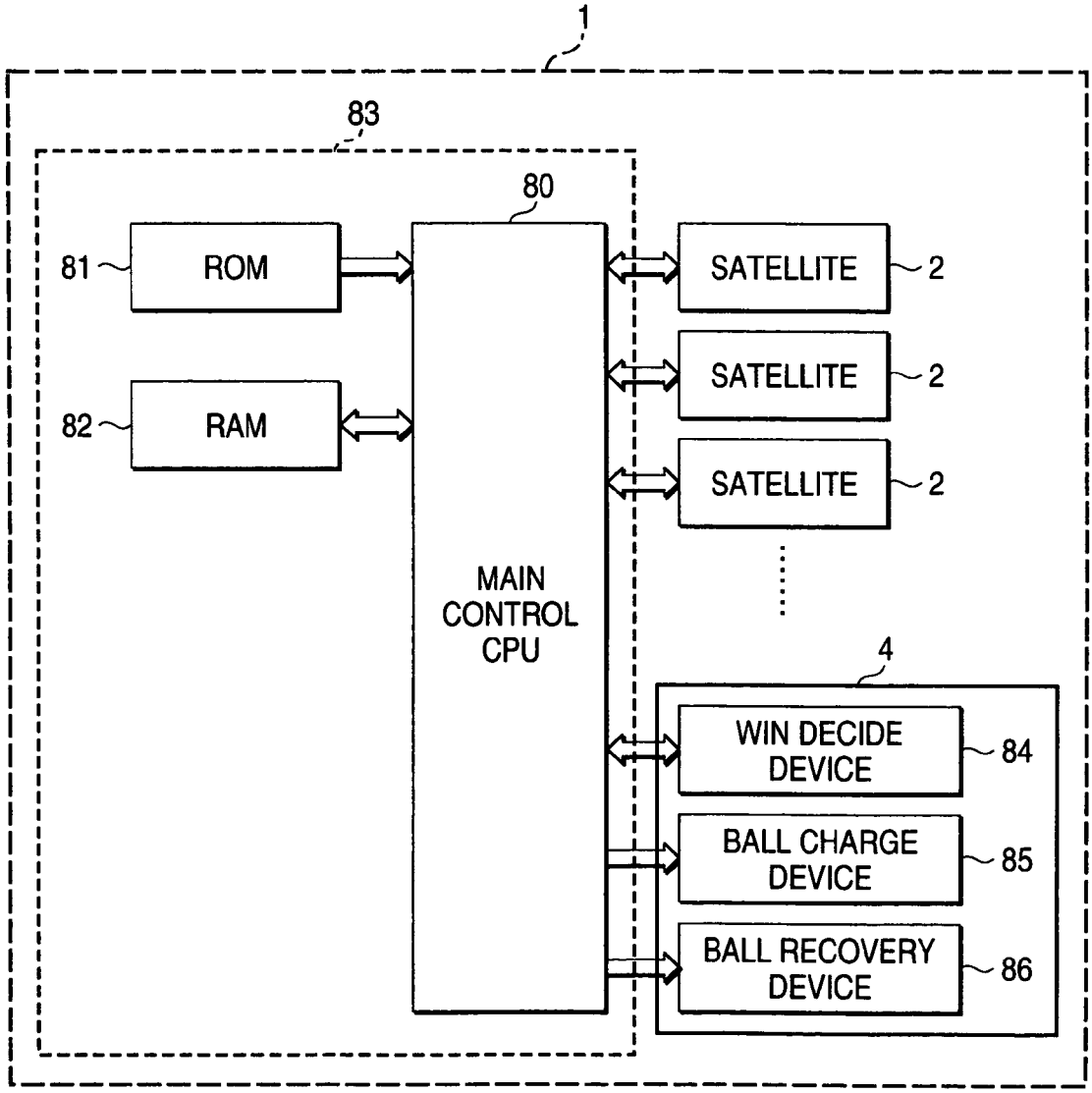
FIG. 8 is a block diagram schematically showing a control system of the roulette game machine according to the embodiment.

Next, the configuration of the control system of the roulette game machine 1 is described with reference to FIG. 8. FIG. 8 is a block diagram schematically showing the control system of the roulette game machine.

As shown in FIG. 8, the roulette game machine 1 is configured to include: a main control unit 83 composed of a main control CPU 80, a ROM 81 and a RAM 82; the roulette wheel 4 connected with the main control unit 83; and the ten satellites 2 (as referred to FIG. 1). The control line of the satellites 2 will be described in detail.

On the basis of the input signals or the like fed from the individual satellites 2 and the data and programs stored in the ROM 81 and the RAM 82, the main control CPU 80 executes various operations and transmits instruction signals based on the operation results to the satellites 2 thereby to control the individual satellites 2 initiatively to proceed the game. The main control CPU 80 further controls a win decide device 84, a ball charge device 85 and a ball recovery device 86, which are disposed in the roulette wheel 4, thereby to insert the ball 16 into the roulette wheel 4, to make recovery from the roulette wheel 4 and to decide the winning number of the ball receiving compartment 13, onto which the ball 16 has fallen.

The ROM 81 is configured of a semiconductor memory or the like, for example, and is stored with: programs for realizing the basic functions of the roulette game machine 1; programs for controlling the individual devices in the roulette wheel 4; odds (i.e., the numbers of credits to be paid back for a win) to the individual BET areas 42 and 52; and programs for controlling the individual satellites 2 initiatively.

On the other hand, the RAM 82 is temporarily stored with: pieces of chip betting information fed from the individual satellites 2; winning number data decided by the win decide device 84; and data on the operation results executed by the main control CPU 80.

The win decide device 84, the ball charge device 85 and the ball recovery device 86, which are disposed in the roulette wheel 4, are connected with the main control CPU 80. In case the bets of the player take a predetermined time period at the individual satellites 2, that is, in case the BET timer graphs 39 and 50 of the first BET screen 31 and the second BET screen 33 reach the predetermined position (e.g., the 2/3 position), the ball charge device 85 is driven to charge the ball 16 into the roulette wheel 4.

When the ball 16 gradually lowers its rolling speed and loses the centrifugal force so that it rolls down on the slope of the frame bowl 11 and is received by the ball receiving compartment 13, the win decide device 84 decides the number which is written on the number plate 14 corresponding to the ball receiving compartment 13 having accommodated the ball 16. The win decide device 84 then transmits the decision result to the main control CPU 80. After this, the ball recovery device 86 is driven to recover the ball 16 from the roulette wheel 4.

Figure 9:
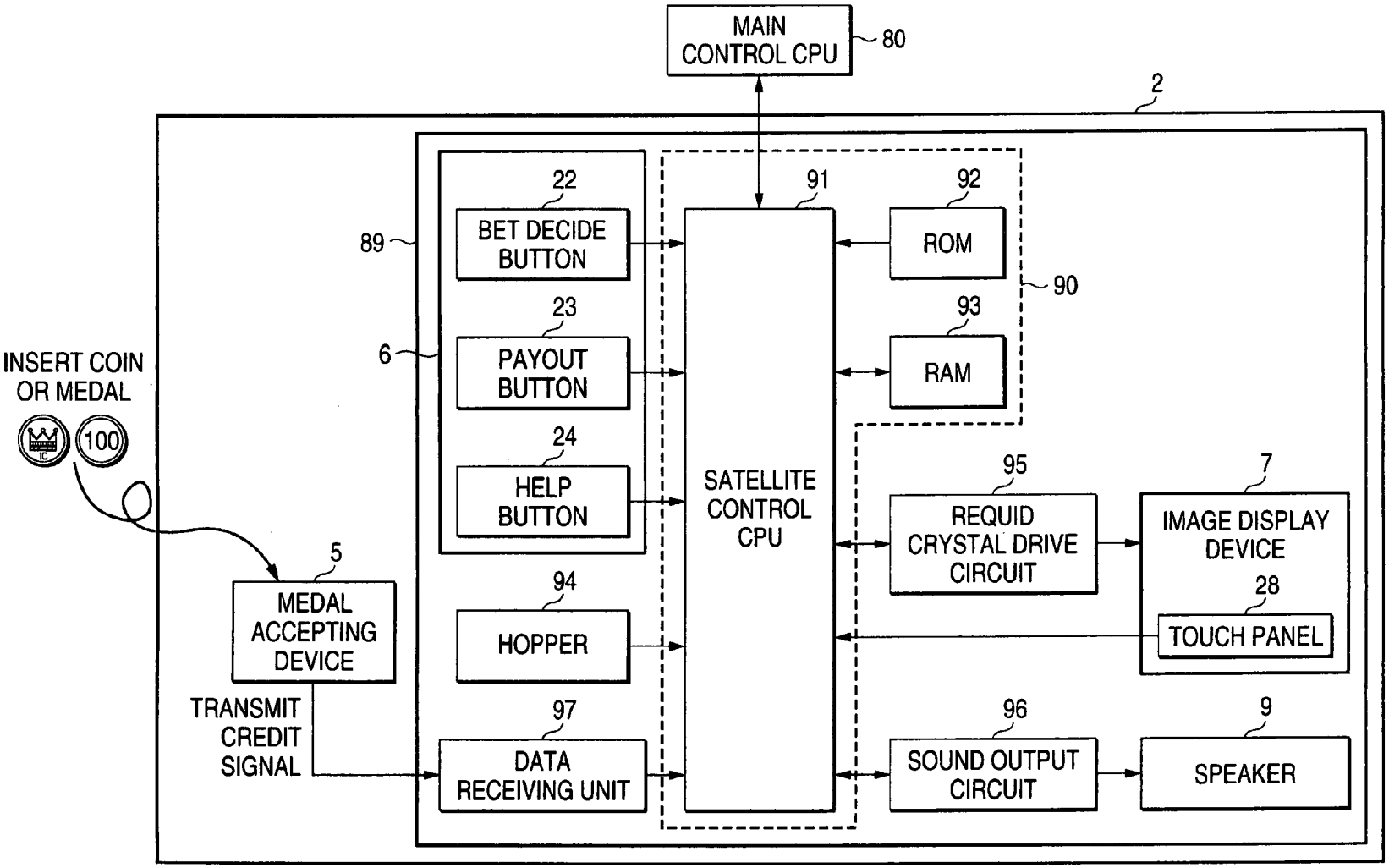
FIG. 9 is a block diagram schematically showing a control system of a satellite according to the embodiment.

With reference to FIG. 9, here is described a configuration of the control line of the satellites 2 which are connected with the CPU 80 of the main control unit 83. FIG. 9 is a block diagram schematically showing the control line of the satellites according to this embodiment. Here, the ten satellites 2 basically have an identical configuration, and the following description is made on one satellite 2.

As shown in FIG. 9, the satellite 2 is basically composed of a body unit 89 having the image display device 7 and so on, and the medal accepting device 5 attached to the body unit 89. Moreover, the body unit 89 is composed of a satellite control unit 90 and several peripheral device units. The satellite control unit 90 is composed of a satellite control CPU 91, a ROM 92 and a RAM 93. The ROM 92 is configured of a semiconductor memory or the like, for example, and is stored with: programs for realizing the basic functions of the satellite 2; other various programs necessary for controlling the satellite 2; data tables; and so on. Moreover, the RAM 93 is a memory, which is temporarily stored with: the various data operated in the satellite control CPU 91; the number of credits being owned by the player; the chip betting situation by the player; and so on.

The BET decide button 22, the PAYOUT button 23 and the HELP button 24, which are disposed in the control unit (as referred to FIG. 1) , are individually connected with the satellite control CPU 91. On the basis of the operation signals outputted by pushing the individual buttons, moreover, the satellite control unit 91 makes controls to execute the corresponding various actions. On the basis of the input signal fed from the control unit 6 in response to the input of the operation of the player and the data and programs stored in the ROM 92 and the RAM 93, the satellite control CPU 92 executes the various operations and transmits the operation results to the main control CPU 80 of the main control unit 83.

On the other hand, the satellite control CPU 91 receives the instruction signals from the main control CPU 80 and controls the peripheral devices configuring the satellite 2 thereby to proceed the roulette game in the satellite 2. Depending on the contents of the operations, moreover, on the basis of the input signals fed from the control unit 6 in response to the input operation of the player and the data and programs stored in the ROM 92 and the RAM 93, the satellite control CPU 91 executes the various operations, and controls the peripheral devices configuring the satellite 2 on the basis of the execution results thereby to proceed the roulette game in the satellite 2. It is decided for each operation according to the contents of the operation which method the operation is to be executed. For example, the payout of medals to the winning number corresponds to the former, and the operation for the player to bet the first BET screen 31 and the second BET screen 33 corresponds to the latter.

A hopper 94 is connected with the satellite control CPU 91. In response to the instruction signal from the satellite control CPU 91, the hopper 94 pays out a predetermined number of medals from the medal payout opening 8 (as referred to FIG. 1).

Moreover, the image display device 7 is connected with the satellite control CPU 91 through a liquid crystal drive circuit 95. This liquid crystal drive circuit 95 is composed of a program ROM, an image ROM, an image control CPU, a work RAM, a VDP (Video Display Processor), a video RAM and so on. The program ROM is stored with image controlling programs concerning the display at the image display device 7, and various select tables. The image ROM is stored with dot data for forming an image to be displayed in the image display device 7, for example. On the basis of parameters set in the satellite control CPU 91 and in accordance with the image control programs stored in advance in the program ROM, the image control CPU decides the image to be displayed in the image display device 7, from the dot data stored in advance in the image ROM. The work RAM is configured as a temporary storage unit at the time when the image control programs are to be executed in the image control CPU. The VDP forms an image according to the display contents determined by the image control CPU, and outputs the formed image to the image display device 7. The video RAM is configured as a temporary storage unit at the time when the image is to be formed by the VDP.

To the front face of the image display device 7, as described hereinbefore, there is attached the touch panel 28, the operation information of which is transmitted to the satellite control CPU 91. In the touch panel 28, the player makes the betting operation of chips on the first BET screen 31 and the second BET screen 33. Specifically, for the selection of the BET areas 42 and 52, for the operation of the screen change buttons 34 and 46 and the unit BET buttons 36 and 47 and for the push of each of the BET width select buttons (51A to 52G) at the BET width select unit 51, the operation of the touch panel 28 is done, and its information is transmitted to the satellite control CPU 91. On the basis of this information, the bet information of the player at play is temporarily stored in a bet information storage area 93A of the RAM 93. This bet information is transmitted to the main control CPU 80.

A sound output circuit 96 and the speaker 9 are connected with the satellite control CPU 91. On the basis of the output signals from the sound output circuit 96, the speaker 9 produces various effect sounds.

A data receiving unit 97 is connected with the satellite control CPU 91, and the medal accepting device 5 is connected with the data receiving unit 97. The medal accepting device 5 is the device for the player to insert the game media such as coins or medals for the play.

The data receiving unit 97 receives the credit signal transmitted from the medal accepting device 5. The credit signal is the information on the additional credit number based on the game media such as the coins or medals inserted into the medal accepting device 5. On the transmitted credit signal, the satellite control CPU 91 increases the credit number of the player, which is stored in an owned credit number storage area 93B of the RAM 93.

Figure 10:
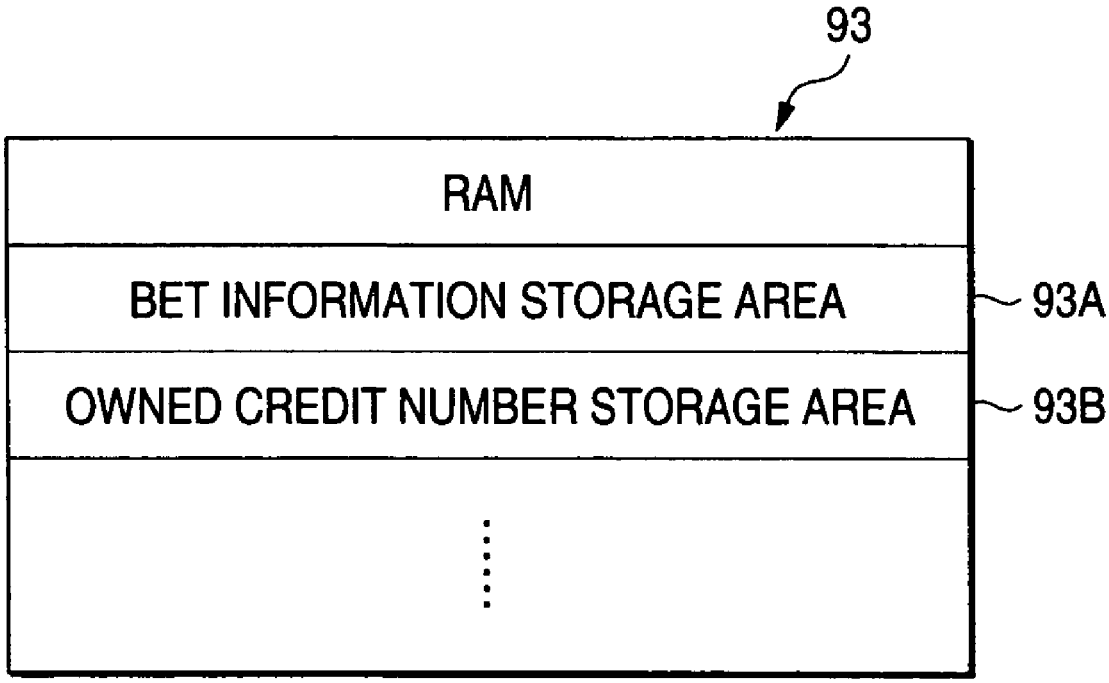
FIG. 10 is a schematic diagram showing a storage area of a RAM of a medal accepting device according to the embodiment.

As shown in FIG. 10, the RAM 93 is provided with the bet information storage area 93A for storing the bet information of the player at play, and the owned credit number storage area 93B for storing the credit number owned by the player at play.

Figure 11:
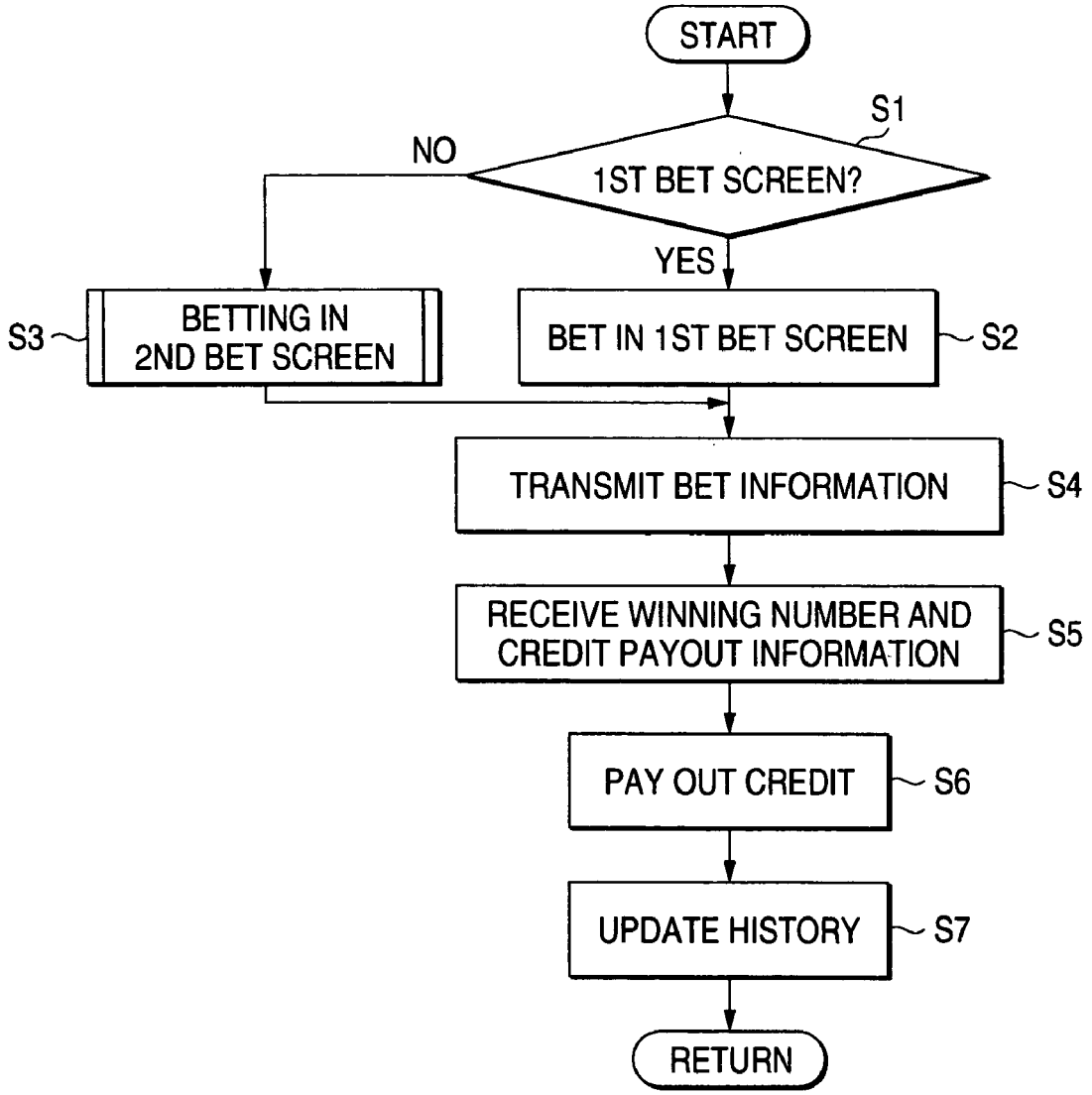
FIG. 11 is a flow chart of a main processing program of a second BET screen according to the embodiment.

Subsequently, the main processing program in the satellite 2 is described with reference to FIG. 11. FIG. 11 is a flow chart of the main processing program in the satellite. These individual programs shown in FIG. 11 are stored in the ROM 92 and the RAM 93 belonging to the satellite 2 and are executed by the satellite control CPU 91.

At first Step (as will be abbreviated into "S") 1, the satellite control CPU 91 decides whether or not the screen being displayed on the image display device 7 is the first BET screen 31. The first BET screen 31 and the second BET screen 33 can be alternately interchanged, as described hereinbefore, by pushing the screen change buttons 34 and 46.

In case the first BET screen 31 is displayed (S1: YES), the chips are bet in the first BET screen 31 (at S2). In case the first BET screen 31 is not displayed (S1: NO), that is, in case the second BET screen 33 is displayed, on the contrary, the chips are bet in the second BET screen 33 (at S3). The betting operation on the BET screen 33 will be described in detail.

At subsequent S4, the results of the bet information ("the designated BET areas 42 and 52", "the designate bet width (i.e., only the second BET screen 33)" and "the designated bet number"), which are executed at the aforementioned individual betting operations of S2 and S2, are transmitted to the main control CPU 80 (as referred to FIG. 8) of the main control unit 83. The main control CPU 80 stores the transmitted bet information in the RAM 82. Here, the bet information transmitted to the main control CPU 80 is stored in the bet information storage area 93A of the RAM 93 by the individual betting operations of S2 and S3.

After this, the game is started at the roulette wheel 4, and the win decide device 84 (as referred to FIG. 8) detects the winning number of the fall of the ball 16. Then, the main control CPU 80 calculates the number of credits to be paid back to the individual satellites 2 with the winning number detected, the pieces of bet information stored in the RAM 82, and the odds (i.e., the payout number of credits to the win) stored in the ROM 81 and corresponding to the individual BET areas 42 and 52, and transmits the credit number together with the winning number to the satellites 2. Then, the satellites 2 receive the individual pieces of information on the winning number and the credit payout information transmitted.

On the basis of the information received at S5, the credits are subsequently paid out and added to the credits being owned by the player (at S6). Then, the credit number to be stored in the owned credit number storage area 93B is changed, and the payout result display units 37 and 48 displayed in the image display device 7 for indicating the balance of the credit of the previous game and the credit number display units 38 and 48 (as referred to FIG. 3 and FIG. 4) for indicating the credit numbers owned by the player at play are updated at the same time. On the other hand, the players can know their credit numbers and so on by confirming the individual display units 37, 38, 48 and 49.

At S7, the history of the winning numbers is updated. This history of the winning numbers is displayed by the result display units 35 and 45 and the history graph 53 (in only the second BET screen 33).

The result history display unit 45 displays a list of the results of the winning numbers of the preceding games. When one game ends, the new winning number is displayed additionally from the top so that the history of the winning numbers of sixteen games at the maximum can be confirmed.

On the other hand, the history graph 53 is so arranged (as referred to FIG. 6) on the inner side of the number display portion 54 displaying the numbers as to correspond to the individual BET areas 52, and is composed of the first graph area 55, the second graph area 56 and the third graph area 57 corresponding to each of the BET areas 52. On the basis of the winning number received at S5, moreover, the history graph 53 corresponding to the number (or the BET area 52), which has won even once for the past 100 games, is lit at its first graph area corresponding to the winning number. In case a number has won at three or more times, the second graph area corresponding to the winning number is lit. In case a number has won at five or more times, the third graph area corresponding to the winning number is lit.

When the player is to know the past game result, therefore, the player can judge it visually easily what position of the wheel and how often the ball 16 falls and hits at. This effect is improved better because the numerals are displayed in the same wheel array as that of the actual roulette wheel 4 in the wheel type betting board 32 disposed in the second BET screen 33, as has been described hereinbefore.

Figure 12:
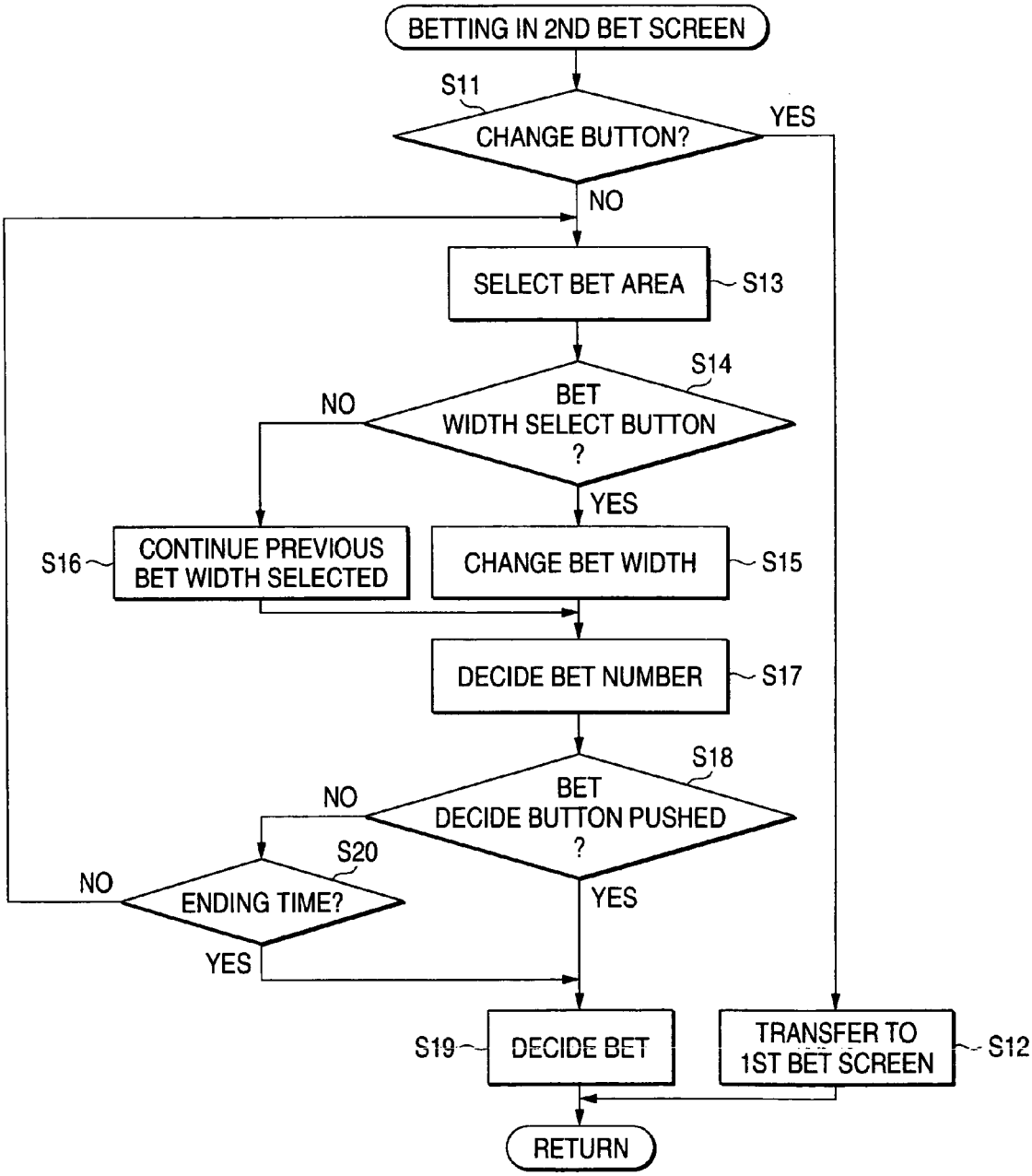
FIG. 12 is a flow chart of a betting operation program in the second BET screen according to the embodiment.

Subsequently, the betting operation program in the second BET screen 33 (as referred to FIG. 4) of S3 is described with reference to FIG. 12. FIG. 12 is a flow chart of the betting operation program in the second BET screen 33. These individual programs shown in the flow chart of FIG. 12 are stored in the ROM 92 and the RAM 93 belonging to the satellites 2, and are executed by the satellite control CPU 91.

At first S11, the satellite control CPU 91 decides whether or not the screen change button 46 has been pushed. In case the screen change button 46 is pushed (S11: YES), the routine transfers to the first BET screen 31 (as referred to FIG. 3) (at S12). The first BET screen 31 displays the table type betting board 30 having the numerals and the symbols arrayed on the checkers as in the table type betting board 30 like those of the prior art, and the player bets the chips on the basis of the table type betting board 30 (at S2). Here is omitted the description of the betting operation (at S2) in the first BET screen 31, because it has already been well known in the art. In case the screen change button 46 is not pushed (S11: NO), on the contrary, the routine transfers to S13.

At next S13, the BET area 52 for betting the chips is selected in the wheel type betting board 32 displayed on the image display device 7. The selection of the BET area 52 is executed by using the touch panel 28 attached to the screen. When the player pushes the corresponding BET area 52 (on the number display portion 54) with the finger, the cursor 59 moves to the corresponding BET area 52 so that the selection is made. After this, the routine transfers to S14.

At S14, it is decided by the satellite control CPU 91 whether or not any of the BET width select buttons 51A to 51G has been pushed. The BET width select buttons are composed of seven kinds of buttons of the 1-width select button 51A, the 3-width select button 51B, the 5-width select button 51C, the 7-width select button 51D, the 9-width select button 51E, the 11-width select button 51F and the 15-width select button 51G, which are disposed in the BET width select unit 51. These select buttons can select the bet widths at "1", "3", "5", "7", "9", "11" and "15", respectively.

In case any of the BET width select buttons 51A to 52G is pushed (S14: YES), the bet width is changed (at S15) to that defined by the BET width select button. In case none of the BET width select buttons 51A to 51G is not pushed (S14: NO), on the contrary, the BET is continued with the bet width already selected (at S16). Here, the bet width basically remains that selected at the previous time, so long as another of the BET width select buttons 51A to 51G is pushed. In the initial state just after the power was turned ON, moreover, the bet width is selected at "1". After this, the routine transfers to S17.

At S17, the BET area 52 selected at S13 is set with the bet number of chips with the bet width selected at S15 and S16. The player pushes each of the unit buttons (i.e., the 1-BET button 36A, the 5-BET button 36B, the 10-BET button 36C and 100-BET button 36D) of the unit BET button 47. Then, the chips of the unit number are bet in the designated BET area 52 (or in the plural BET areas in case the bet width is selected at a number other than "1"). On the wheel type betting board 32, moreover, there is displayed the chip symbol 41 indicating the number of chips and the BET area or areas 52, which have been bet till then. The bet number of chips is displayed with the numeral displayed on the chip symbol 41 (as referred to FIG. 4). The pieces of bet information (i.e., "the designated BET area 52", "the designated bet width" and "the designated bet number") by the operations thus far described are temporarily stored in the bet information storage area 93A.

Next, it is decided at S18 by the satellite control CPU 91 whether or not the BET decide button 22 has been pushed. The BET decide button 22 is disposed in the control unit 6, as shown in FIG. 1 and FIG. 9, and is pushed when the series of betting operations at S13 to S17 are to be decided.

In case the BET decide button 22 is pushed (S18: YES), the bet is decided (at S19). After the bet was decided, the betting operations of S13 to S17 cannot be performed till the next game is started. After the bet was decided, moreover, the win occurs in case the player bet the number described on the number plate 14 corresponding to the ball receiving compartment 13, on which the ball 16 was trapped in the roulette wheel 4 having started the game. In the winning case, the credit of the number corresponding to the bet chips is added to the credit being owned by the player at play.

In case the BET decide button 22 is not pushed (S18: NO), on the contrary, it is then decided (at S20) whether or not the betting time period has ended. The betting time period is displayed by the BET timer graph 50 disposed in the upper portion of the wheel type betting board 32. The BET timer graph 50 displays the residual time period, for which the player can bet, such that a red bar gradually extends rightward from the game start. The betting time period terminates when the bar extends to the righthand extremity.

In case the betting time period does not end (S20: NO), that is, in case the BET timer graph 50 does not extent to the righthand extremity, the routine returns to S13, at which the bet can be made again. By repeating the aforementioned operations of S13 to S17, moreover, the wheel type betting board 32 can be bet at its plural portions.

In case the betting time period ends (S20: YES), on the contrary, the bet is decided according to the current bet situation (at S19). When the bet is decided, the aforementioned betting operations of S13 to S17 cannot be made till the next game is started.

In the satellite 2 thus far described according to this embodiment, the first BET screen 31 having the table type betting board 30 and the second BET screen 33 having the wheel type betting board 32 can interchanged and displayed by pushing the screen change buttons 34 and 46. In the second BET screen 33, moreover, the numbers of the number display portion 54 forming the BET areas 52 are identical to those of the number plates 14 disposed on the roulette wheel 4, and are arranged in the wheel shape in the identical array. Therefore, it is possible to expect the BET areas 52 to be bet, in visual correlation to the array of the numbers actually displayed on the roulette wheel. On the basis of the arrangement of the numbers of the roulette wheel 4, therefore, the BET areas 52 to be bet can be expected to diversify the amusements so that the player will not lose interest. Moreover, even the beginner can understand the roulette game machine easily so that the player can easily bet.

In the second BET screen 33, the history graph 53 that displays the history of the wining numbers as a bar graph is so arranged on the inner side of the number display portion 54, and lit based on the history of the wining numbers. When the player is to know the past game result, therefore, the player can judge it visually easily what position of the wheel and how often the ball 16 falls and hits at. This effect is improved better because the numerals are displayed in the same wheel array as that of the actual roulette wheel 4 in the wheel type betting board 32 disposed in the second BET screen 33, as has been described hereinbefore.

In the wheel type betting board 32, moreover, not only the designated BET area 52 but also the adjoining BET areas 52 can be simultaneously bet by selecting the bet width in the BET width select unit 51. Therefore, the player can bet the number around a point easily in view of the aforementioned history graph 53 while expecting the point at which the ball 16 falls. As a result, the player can enjoy the various types of plays so that his or her playing desire can be promoted.

By pushing the screen change button 46, on the other hand, the first BET screen 31 can be displayed for a bet using the table type betting board 30 so that the bet can be made considering the various desires of the player.

As the above, according to a first aspect of the embodiment, there is provided a betting apparatus (e.g., a satellite 2) including: a bet area display unit (e.g., an image display device 7) for displaying a plurality of bet areas (e.g., BET areas 42 and 52) formed on the basis of the same symbols of a plurality of symbols (e.g., number plates 14) arranged on a roulette wheel (e.g., a roulette wheel 4); a select unit (e.g., a touch panel 28) for selecting the individual bet areas displayed by the bet area display unit; and a bet unit (e.g., unit BET buttons 36 and 47) for betting the bet area selected by the select unit, wherein the bet areas are formed on the basis of symbols (e.g., a number display portions 54) arranged in a wheel shape in the same array as the symbols arranged on the roulette wheel.

According to a second aspect of the embodiment, in the betting apparatus (e.g., the satellite 2) as set forth in the first aspect of the embodiment, the bet unit can bet the plural bet areas including the bet area selected by the select unit, simultaneously.

According to a third aspect of the embodiment, the betting apparatus (e.g., the satellite 2) as set forth in the second aspect of the embodiment, further includes a bet area number select unit (e.g., a BET width select unit 51) for selecting the number of the bet areas (e.g., the BET areas 42 and 52) bet simultaneously by the bet unit (e.g., the unit BET buttons 36 and 47).

According to a fourth aspect of the embodiment, the betting apparatus (e.g., the satellite 2) as set forth in any of the first to the third aspect of the embodiment, further includes a change unit (e.g., screen change buttons 34 and 46) for changing the array of the symbols (e.g., the number display portion 54) to form the bet areas (e.g., the BET areas 42 and 52).

According to a fifth aspect of the embodiment, in the betting apparatus (e.g., the satellite 2) as set forth in the fourth aspect of the embodiment, the change unit (e.g., the screen change buttons 34 and 46) includes: a first change unit (e.g., the screen change button 46) for arraying and arranging the symbols arranged in the wheel shape, in a checker shape; and a second change unit (e.g., the screen change button 34) for arranging the symbols arrayed and arranged in the checker shape by the first change unit, in the wheel shape.

According to a sixth aspect of the embodiment, the betting apparatus (e.g., the satellite 2) as set forth in any of the first to the fifth aspect of the embodiment, further includes a result display unit (e.g., a history graph 53) for displaying the result of the game in the roulette wheel (e.g., the roulette wheel 4), wherein the result display unit is arranged in the wheel shape to correspond to the individual ones of the bet areas (e.g., the BET areas 52).

According to a seventh aspect of the embodiment, in a betting apparatus (e.g., the satellite 2) as set forth in the sixth aspect of the embodiment, the result display unit (e.g., the history graph 53) changes and displays display areas (e.g., a first graph area 55, a second graph area 56 and a third graph area 57) on the basis of the winning ratio of the bet areas (e.g., the BET areas 52).

In the betting apparatus according to the first aspect of the embodiment, the bet areas are formed on the basis of the symbols which are arranged in the wheel shape in the same array as that of the symbols arrayed on the roulette wheel. This makes it possible to expect the bet area to be bet, in visual correlation to the array of the symbols actually displayed on the roulette wheel. On the basis of the arrangement of the symbols of the roulette wheel, therefore, the bet area to be bet can be expected to diversify the amusements so that the player will not lose interest. Moreover, even the beginner can understand the roulette game machine easily so that the player can easily bet.

In the betting apparatus according to the second aspect of the embodiment, the plural bet areas including the selected bet area can be simultaneously bet.

In the betting apparatus according to the third aspect of the embodiment, the number of bet areas to be simultaneously bet by the bet unit can be selected. Therefore, the player can bet the chips all at once for the plural bet areas designated by the players, while expecting the point, on which the ball falls in the roulette wheel. As a result, the player can enjoy the various game types, and a playing interest of the player can be stimulated.

In the betting apparatus according to the fourth aspect of the embodiment, the array of the symbols forming the bet areas can be changed. Therefore, the betting method by the betting apparatus can be diversified to provide the play modes satisfying the various desires of the player.

In the betting apparatus according to the fifth aspect of the embodiment, the symbols arranged in the wheel shape can be changed so that they are arranged and arranged in the checker shape, and the symbols arrayed and arranged in the checker shape can be rearranged in the wheel shape. As a result, the bet area formed by the symbols arranged in the checker shape of the prior art and the bet areas formed by the symbols arranged in the wheel shape can be selected and displayed to bet the chips. As a result, the play modes satisfying the various desires of the player can be provided to stimulate the playing interests of the player.

In the betting apparatus according to the sixth aspect of the embodiment, the result display unit for displaying the result of the game in the roulette wheel is arranged in the wheel shape to correspond to the bet areas. When the player is to know the past game results, the player can decide it visually easily what position of the roulette wheel and how often the ball has fallen to win at.

In the betting apparatus according to the seventh aspect of the embodiment, the game results are displayed by changing the display areas on the basis of the winning ratio of the bet areas. When the player is to know the past game results, the player can decide it visually easily what position of the roulette wheel and how often the ball has fallen to win at.

The invention should not be limited to the embodiment thus far described but can naturally be improved and modified in various manners without departing from the gist thereof.

In the embodiment, for example, the bet width can be selected from any of "1", "3", "5", "7", "9", "11" and "15" by the BET width select unit 51 disposed in the second BET screen 33. However, the satellite 2 may be provided with another numeral input unit for designating the bet width direction with a numeral. This makes it possible to select a finer bet width.

In the embodiment, on the other hand, the history graph 53 for displaying the history of the winning numbers in the bar shape is arranged on the inner side of the number display portion 54, but may also be arranged on the outer side.

In addition to the display in the bar graph shape by the history graph 53, the winning frequency may also be displayed by changing the color of the number display portion 54. In case one or more wins has been revealed from the result of the 100 past games, for example, the number display portion 54 of the winning number is lit in green. In case three or more wins have occurred, for example, the number display portion 54 of the winning number is lit in yellow. In case five or more wins have occurred, for example, the number display portion 54 of the winning number is lit in red to facilitate the decision.

In this embodiment, on the other hand, both the BET area 52 selected with the cursor 59 and the BET areas 52 positioned by equal numbers on the two sides can be simultaneously bet with the bet width selected by the BET width select unit 51. It is arbitrary to bet the selected BET area 52 and the plural BET areas 52 positioned on the righthand (or clockwise) side of the former at the same time.

What is claimed is:

1. A betting apparatus comprising:

a bet area display unit for displaying a plurality of bet areas formed on the basis of the same symbols of a plurality of symbols arranged on a roulette wheel which is separate from the bet area display unit;

a select unit for selecting the individual bet areas displayed by the bet area display unit; and a bet unit for betting the bet area selected by the select unit, wherein the plurality of bet areas are formed on the basis of symbols arranged in a wheel shape in the same array as the symbols arranged on the separate roulette wheel, and wherein the betting apparatus further comprises a history graph within the individual bet areas, the history graph indicating a winning percentage for the individual bet areas, and comprising a first graph area, a second graph area, and a third graph area that are arranged on an inner side of a number display portion, wherein the first graph area, the second graph area, and the third graph area are lit and indicated on a basis of a history of the winning percentage.

2. The betting apparatus according to claim 1, wherein the bet unit bets the plural bet areas including the bet area selected by the select unit, simultaneously.

3. The betting apparatus according to claim 2, further comprising a bet area number select unit for selecting the number of the bet areas bet simultaneously by the bet unit.

4. The betting apparatus according to claim 1, further comprising a change unit for changing the array of the symbols to form the bet areas.

5. The betting apparatus according to claim 4, wherein the change unit includes:

a first change unit for arraying and arranging the symbols arranged in the wheel shape, in a checker shape; and a second change unit for arraying and arranging the symbols arrayed in the checker shape, in the wheel shape.

6. The betting apparatus according to claim 1, further comprising a result display unit for displaying the result of the game in the roulette wheel, wherein the result display unit is arranged in the wheel shape to correspond to the individual ones of the bet areas.

7. The betting apparatus according to claim 6, wherein the result display unit changes and displays display areas on the basis of the winning ratio of the bet areas.

8. The betting apparatus according to claim 7, wherein the display areas are divided into a plurality of steps.

9. The betting apparatus according to claim 8, wherein the bet areas that have the similar winning ratio is bet simultaneously.

10. The betting apparatus according to claim 1, further comprising:

a second result display unit for displaying the result of the game to the roulette wheel, wherein the second result display unit displays the number of bet areas having similar winning ratio.

11. The betting apparatus according to claim 10, wherein the bet areas is classified into a plurality of steps based on the wining ratio.

12. The betting apparatus according claim 11, wherein the bet areas that has the similar winning ratio is bet simultaneously.

13. The betting device according to claim 1, wherein the history graph is adapted to plot a history of hits for the bet area of the individual bet areas over a predetermined number of games.

14. The betting device according to claim 1, wherein the select unit also selects the bet width of the individual bet areas displayed by the bet area display unit.

15. The betting device according to claim 1, wherein the bet unit determines an amount of units that is bet on each of the bet areas selected by the select unit.

16. A betting apparatus, comprising:

a roulette wheel; and a bet area display unit for displaying a plurality of bet areas, each bet area including a symbol that is the same as one of a plurality of symbols arranged on the roulette wheel;

wherein the plurality of bet areas are arranged based on each symbol of a bet area of the plurality of bet areas arranged in a wheel shape and in a same array as the plurality of symbols arranged on the roulette wheel, and wherein the betting apparatus further comprises a history graph within the bet area of the plurality of bet areas, wherein the history graph indicates a winning percentage for the bet area of the plurality of bet areas, wherein the history graph comprises a first graph area, a second graph area, and a third graph area that are arranged on an inner side of a number display portion, and wherein the first graph area, the second graph area, and the graph area are lit and indicted on a basis of a history of the winning percentage.

17. A betting method, comprising:

displaying a plurality of bet areas;

selecting at least one of the plurality of bet areas;

selecting a bet width of at least one of the plurality of bet areas;

selecting a bet number to set with the selected bet width; and deciding a bet by operating a roulette wheel, wherein the plurality of bet areas are arranged based on each symbol of a bet area of the plurality of bet areas arranged in a wheel shape and in a same array as a plurality of symbols arranged on the roulette wheel, and wherein the bet area of the plurality of bet areas comprises a history graph, wherein the history graph indicates a winning percentage for the bet area of the plurality of bet areas, wherein the history graph comprises a first graph area, a second graph area, and a third graph area that are arranged on the inner side of a number display portion, and wherein the first graph area, the second graph area, and the third graph are lit and indicated on the basis of the history of the winning percentages.

* * * * *